United States Patent [19]

Calhoun

[11] Patent Number: 4,805,892

[45] Date of Patent: Feb. 21, 1989

[54] CROSS-TRACK REGISTRATION DEVICE FOR SHEET TRANSPORT SYSTEM

[75] Inventor: Lee M. Calhoun, Bergen, N.Y.

[73] Assignee: Eastman Kodak Company, Rochester, N.Y.

[21] Appl. No.: 177,245

[22] Filed: Apr. 4, 1988

[51] Int. Cl.[4] ..... B65H 7/14

[52] U.S. Cl. ..... 271/225; 226/17; 226/20; 271/227; 271/236; 271/242; 271/250; 271/270; 271/229; 242/57.1

[58] Field of Search ..... 271/225–265, 271/272, 266, 268, 270, 271, 273, 19, 182; 226/15–45; 242/57.1

[56] References Cited

U.S. PATENT DOCUMENTS

| | | | |
|---|---|---|---|
| 3,368,726 | 2/1968 | Funk et al. | 226/17 |
| 3,863,913 | 2/1975 | Hirafuji | 271/270 X |
| 3,966,198 | 6/1976 | Komada et al. | 271/270 X |
| 4,021,031 | 5/1977 | Meihofer et al. | 226/20 |
| 4,049,213 | 9/1977 | Hank et al. | 226/20 X |
| 4,077,579 | 3/1978 | Seleski et al. | 226/20 X |
| 4,300,756 | 11/1981 | Danchak, Jr. et al. | 271/242 X |
| 4,303,189 | 12/1981 | Wiley et al. | 226/20 X |
| 4,337,935 | 7/1982 | Sawada et al. | 271/242 X |
| 4,453,659 | 6/1984 | Torpey | 226/20 |
| 4,480,825 | 11/1984 | Landa | 271/182 X |
| 4,500,045 | 2/1985 | Whitaker et al. | 226/20 X |
| 4,635,920 | 1/1987 | Kodama | 271/225 X |
| 4,645,192 | 2/1987 | Watanabe | 271/242 X |
| 4,685,664 | 8/1987 | Petersdorf | 271/227 |
| 4,721,297 | 1/1988 | Katayama | 271/242 X |
| 4,731,542 | 3/1988 | Doggett | 226/20 X |

*Primary Examiner*—Douglas C. Butler

*Attorney, Agent, or Firm*—Leonard W. Treash, Jr.

[57] ABSTRACT

A loop is formed between upstream and downstream pairs of rollers by driving the downstream pair slower than the upstream pair and/or by a direction changing guide. The downstream pair of rollers is axially movable to bring an in-track edge of a sheet to a predetermined sensed position to cross-track register the sheet. The loop permits cross-track movement of the sheet despite engagement of the sheet with the upstream pair of rollers.

7 Claims, 1 Drawing Sheet

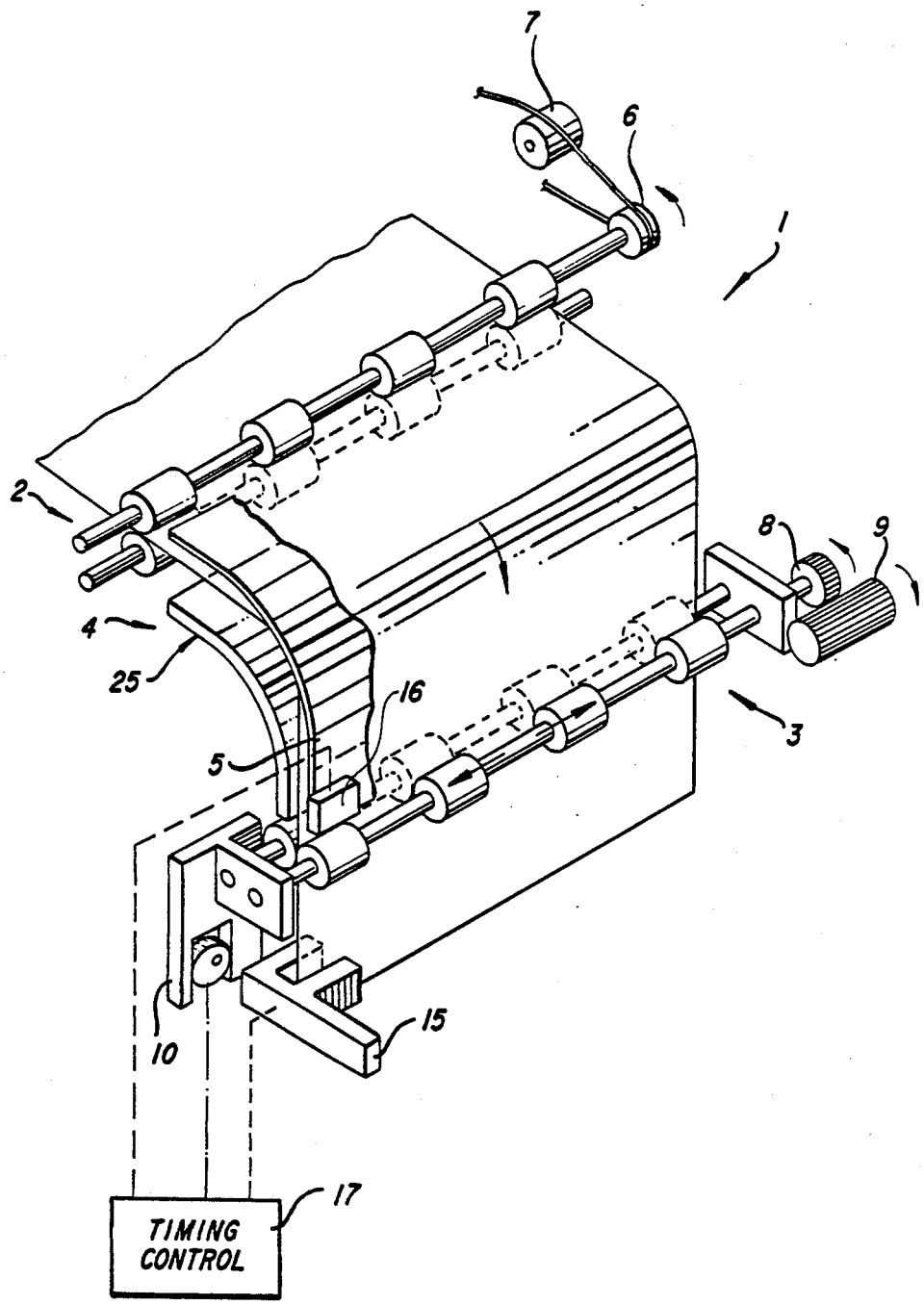
7
6
1
2
8
9
4
25
16
3
5
10
15
17
TIMING CONTROL

CROSS-TRACK REGISTRATION DEVICE FOR SHEET TRANSPORT SYSTEM

TECHNICAL FIELD

This invention relates to sheet handling, for example, to a sheet transport system of the type found in copiers and page printers.

BACKGROUND ART

To assure accurate position of an image on a sheet of paper in a copier or page printer using cut sheets, it is important that the sheet have reasonably accurate cross-track registration when receiving that image. The term "cross-track" is used to describe the direction across the path of travel of a sheet, and "cross-track registration" would be accurate location of that sheet in the cross-track direction. "In-track" is the direction parallel to the movement of the sheet in its path and the in-track edges of a sheet would be the edges parallel to the movement of the sheet.

U.S. Pat. No. 4,685,664, Petersdorf, shows a cross-track registration device for a sheet transport system in which upstream and downstream pairs of rollers drive a sheet along a path. As the sheet approaches the downstream pair of rollers while being driven by the upstream pair of rollers, the downstream pair of rollers is stopped. As the leading edge of the sheet engages the stopped downstream pair of rollers a loop is formed in the sheet. After formation of the loop the downstream pair of rollers is driven to advance the sheet. The loop is maintained by the continuously driven upstream rollers. A sensing device senses the cross-track position of an in-track edge of the sheet after it exits the downstream pair of rollers. The downstream pair of rollers are moved axially until the in-track edge being sensed is located at a predetermined cross-track position as sensed by the sensing means to thereby register the sheet in the cross-track direction. Cross-track movement of the downstream rollers without tearing the sheet is permitting by the loop.

This device is very effective in registering a sheet in the cross-track direction, however, the requirement that the downstream pair of rollers be stopped during a portion of each sheet's transportation through the device requires complicated and expensive timing mechanism for the drives on the downstream pair of rollers.

DISCLOSURE OF THE INVENTION

It is the object of the invention to provide a cross-track registration device generally of the type described but in which some of the complexity in the mechanism has been eliminated.

This and other objects are accomplished by providing a cross-track registration device in which both the upstream and downstream pairs of rollers are driven continuously, but in which the downstream pair of rollers is driven at a peripheral speed slower than the peripheral speed of the upstream pair to form a loop in the sheet being transported. With this structure the complexity associated with the prior art timing of starting and stopping the downstream pair of rollers is eliminated.

According to a preferred embodiment the device also includes guide means between the pairs of rollers to direct a sheet from the upstream pair of rollers to the downstream pair of rollers and to control the formation of the loop. Preferably, the guide means directs this sheet through a curved path to a downstream pair of rollers which is located and orientated to receive the sheet now moving in a direction different from the direction the trailing portion of the sheet is moving. For example, the guide means may provide a right angle turn in the path of movement of the sheet.

Although it is much preferred that the guide means be used in cooperation with the slower speed downstream pair of rollers, it is an aspect of this invention that the guide means may be used alone to form the appropriate loop without regard to the relative speeds of the pairs of rollers.

BRIEF DESCRIPTION OF DRAWING

In the detailed description of the preferred embodiment of the invention presented below, reference is made to the accompanying drawing, which is a schematic perspective view of a device constructed according to the invention with portions cut away for clarity of illustration.

BEST MODE OF CARRYING OUT THE INVENTION

According to the drawing, a cross-track registration device 1 includes an upstream pair of rollers 2 and a downstream pair of rollers 3, for driving a sheet along a path. The in-path distance between the pairs of rollers being less than the in-path dimension of a sheet to be transported. For example, the minimum in-track dimension of a sheet to be transported is commonly 21 cm., the width of a letter-size sheet being transported with its longest dimension in the cross-track direction. The in-path distance between the rollers should be less than 21 cm., for example, 12 cm., thereby assuring that both pairs of rollers drive the sheet during a portion of its travel.

A guide means 4 guides a sheet driven by the upstream pair of rollers 2 to the downstream pair of rollers 3. The guide means includes an outside guide 5 which intercepts the sheet and changes its direction of travel to a new direction toward the downstream pair of rollers 3. The extent of such change is not critical. In the structure shown in the drawing, the change in direction is approximately 90 degrees. An inside guide 25 also may be employed inside the curved path. According to the drawing, a loose loop is formed in the sheet between the two pairs of rollers by two characteristics which cooperate in the preferred embodiment, but which could be employed separately. The first characteristic, is the guide means 4, more specifically the outside guide 5 which, in changing the direction of movement of the sheet, initially forms the loop. The second characteristic of the device that forms the loop is that the second pair of rollers is driven at a peripheral speed slower than the first pair of rollers, thereby both forming the loop and maintaining the loop against the outside guide.

The upstream pair of rollers 2 are tendency drive rollers driven through a pulley 6 by a suitable drive 7 thus preventing the rollers 2 from overdriving the loop formed by the guide means 4. The downstream pair of rollers 3 is mounted for movement axially, that is, in the cross-track direction. Thus, it is driven by engagement of a driven gear 8 and a drive gear 9 which is elongated to permit such axial movement. The power for the drive means for both the upstream and downstream pairs of rollers may originate with the same or separate motors, not shown.

As mentioned, the downstream pair of rollers 3 is mounted for movement in an axial direction. That axial movement is provided by a cam 10. Rotation of cam 10 through a full turn moves the downstream pair of rollers from one extent of its movement to the opposite extent of movement and then return.

A cross-track sensor 15 is of the type which senses the presence or absence of a sheet at a particular position within the sensor, for example, by interruption of a light path, as is well known in the art.

A leading edge sensor 16 is located upstream of the downstream pair of rollers. The two sensors 15 and 16 and the drive for cam 10 are all connected to a timing control 17 shown schematically in the drawing.

In operation, a sheet being transported by a sheet transport system arrives at cross-track registration device 1. It is transported by rapidly driven upstream pair of rollers 2 into outside guide 5 which changes its direction and guides the sheet to downstream pair of rollers 3 which are being rotated at a slower peripheral speed. The slower peripheral speed of downstream pair of rollers 3 forces the sheet against the outside guide 5 maintaining a loose loop in the sheet.

Just prior to sheet engagement by the downstream pair of rollers the leading edge of the sheet is sensed by leading edge sensor 16 and a signal sent to the timing control 17. The timing control 17 clocks a suitable amount of time after the signal is sent from the leading edge sensor, for example, by an ordinary clock mechanism or by a certain number of turns of the downstream pair of rollers. This suitable amount of time is sufficient to permit the leading portion of the sheet to reach the vicinity of the cross-track sensor 15. At this time the timing control 17 signals actuation of cam 10 which begins rotation and moves the downstream pair of rollers to the left to the position shown in the drawing, thereby moving the sheet into the cross-track sensor 15. When the cross-track sensor 15 senses the in-track edge of the sheet, for example, by interruption of a light path, it signals the timing control 17 which stops the rotation of cam 10 thereby registering the sheet in the cross-track direction. After the sheet has left the downstream pair of rollers 3 the cam 10 returns to a home position moving those rollers to the right as shown in the drawing. This can be triggered off sensing of the trailing edge of the sheet by either sensor 15 or 16 or another sensor added for that purpose.

The sensor 15 in its simplest form triggers stopping of the cam 10 when a light beam is interrupted by the left in-track edge of a sheet. But it can be more sophisticated. For example, it can send the triggering signal when the sensor changes condition whichever cross-track direction the sheet is moving, thereby sensing the edge regardless which way the rollers are moved and eliminating the necessity of returning the cam 10 to a home position between sheets.

Copiers, page printers and other devices transport and cross-track register sheets of substantial different in-track dimension. For any sheet very much larger than the minimum size the upstream pair of rollers will be driving the sheet while the downstream pair of rollers is moving axially. This is permitted only by the formation of the loop. It is within the scope of the invention that the loop could be formed only by the guide means 4 and the downstream pair of rollers move at the same speed as the upstream pair of rollers. It is also within the scope of the invention that the loop could be formed entirely by the differences in pheripheral speeds of the two pairs of rollers and without the guide means 4, i.e., with the pairs of rollers aligned. However, the cooperation of these two characteristics in forming the loop provides a far more reliable device than either of these characteristics taken alone. Further, compared to the prior art which stops the downstream pair of rollers to form its loop this device is considerably simpler in construction therefore less expensive and less prone to malfunction.

If the sheet is sufficiently short in the in-track dimension that its trailing edge leaves the upstream pair of rollers shortly after the leading portion is engaged by the downstream pair of rollers, the loop is not really necessary to permit the axial movement of the downstream pair of rollers without damage to the sheet and the sheet may rest on the inside guide 25 or the outside guide 5 depending on the orientation of the device with respect to gravity.

Although the device was noted as being useful in copiers and page printers it can be used in any device in which cross-track registration is advantageous. Its application in copiers and page printers can be in several locations in those devices. For example, it can be used in an electrophotographic copier in registering the sheet as it is fed initially to a transfer station to receive a toner image. However, a more likely application is after that same sheet has received one image, the image has been fused, the sheet has been inverted and has been returned through a long duplex path for refeeding to the transfer station to receive an image on its opposite side. With so much handling through such a long path it is common for such sheets to lose their cross-track registration. This device has great application to such duplex paths.

The invention has been described in detail with particular reference to a preferred embodiment thereof, but it will be understood that variations and modifications can be effected within the spirit and scope of the invention as described hereinabove and as defined in the appended claims. For example, belts or other sheet driving means may be used instead of rollers.

I claim:

1. A cross-track registration device for a sheet transport system, comprising:

upstream and downstream pairs of rollers for driving a sheet along a path, the in-path distance between the pairs of rollers being less than the in-path dimension of a sheet to be transported, means for continuously driving both pairs of rollers and for driving the downstream pair at a peripheral speed slower than the peripheral speed of the upstream pair to form a loop in a sheet being transported, means for sensing the cross-track position of an in-track edge of a sheet being driven by the downstream pair of rollers, and means for axially moving the downstream pair of rollers until an in-track edge of a sheet is sensed, thereby registering the sheet in the cross-track direction.

2. A device according to claim 1 further including guide means between said pairs of rollers to direct a sheet from the upstream pair of rollers to the downstream pair of rollers and to control the formation of said loop.

3. A device according to claim 2 wherein said guide means is shaped to direct said sheet through a curved path to said downstream pair of rollers, which downstream pair is located and orientated to receive the leading edge of a sheet moving in a direction different from the direction the trailing portion of the sheet is moving as said trailing portion leaves the upstream pair of rollers.

4. A device according to claim 3 wherein said guide means provides approximately a right angle turn in the path of a moving sheet.

5. A cross-track registration device for a sheet transport system, comprising:

upstream and downstream means for driving a sheet along a path, means for guiding the leading portion of a sheet being driven by the first driving means through a curved path to the downstream driving means, said guide means being positioned and shaped to form a loop in said sheet, cross-track sensing means for sensing an in-track edge of a sheet being driven by the downstream driving means, means for axially moving the downstream driving means until an in-track edge of a sheet is sensed by the cross-track sensing means, thereby registering said sheet in the cross-track direction.

6. A device according to claim 5 wherein guide means provides approximately a right angle turn in the path of a moving sheet.

7. A cross-track registration device for a sheet transport system, comprising:

upstream and downstream means for driving a sheet to transport the sheet along a path;

means for continuously driving the downstream means slower than the upstream means to form a loop in a sheet being transported, means for moving the downstream means in a cross-track direction to move the sheet being transported in a cross-track direction, means for sensing the cross-track position of a sheet being moved in a cross-track direction, and means for stopping said cross-track movement when said sheet reaches a predetermined cross-track position to cross-track register the sheet.

* * * * *